United States Patent [19]

Phillips, Sr.

[11] Patent Number: 4,572,761

[45] Date of Patent: Feb. 25, 1986

[54] PAPER DISPENSING APPARATUS

[76] Inventor: James E. Phillips, Sr., R.D. #1, 320 Disbrow Hill Rd., Hightstown, N.J.

[21] Appl. No.: 628,648

[22] Filed: Jul. 6, 1984

[51] Int. Cl.[4] ..... B32B 31/18

[52] U.S. Cl. ..... 156/511; 83/588; 83/650; 83/928; 156/516; 156/554; 242/42

[58] Field of Search ..... 225/34–38, 225/82; 242/55, 42; 156/511, 516, 554, 510; 83/650, 588, 928

[56] References Cited

U.S. PATENT DOCUMENTS

| | | | |
|---|---|---|---|
| 817,919 | 4/1906 | Jones | 83/588 X |
| 1,215,388 | 2/1917 | Lanford | 83/650 X |
| 1,510,754 | 10/1924 | Walvatne | 83/588 |
| 1,518,750 | 12/1924 | Nelson | 225/38 |
| 2,916,078 | 12/1959 | Hebert, Jr. | 156/554 X |
| 2,978,155 | 4/1961 | Knutson | 242/55.42 X |
| 3,152,032 | 10/1964 | Waltz | 156/554 |
| 3,570,731 | 3/1971 | Waltz | 242/55.42 X |
| 3,847,709 | 11/1974 | Martin | 225/34 X |
| 4,052,248 | 10/1977 | Hunter | 225/38 X |
| 4,426,245 | 1/1984 | Driscoll et al. | 225/38 X |

*Primary Examiner*—Frank T. Yost

*Attorney, Agent, or Firm*—Thomas R. Farino, Jr.

[57] ABSTRACT

A paper dispensing apparatus includes a platform having a pair of wheels and a housing attached to the platform. A plurality of shafts extend upward from the platform to respectively support different widths of paper rolls. A handle may be attached to the housing to assist manipulation of the apparatus by an operator. Cutting blades are mounted in the housing adjacent the respective paper rolls and operate through vertical movement by means of a drawn cable. A shaft extends upward from the platform to support masking tape rolls at a position to overlap the side edge of the paper rolls. Adjustable retaining collars are provided to accommodate varying widths of paper rolls. Retaining springs are provided to apply tension to the paper rolls.

2 Claims, 6 Drawing Figures

PAPER DISPENSING APPARATUS

BACKGROUND OF THE INVENTION

The present invention is directed broadly at the dispensing of an adhesive masked paper and more particularly, at the dispensing of paper from a hand-carried, or pulled, dispenser apparatus capable of accommodating different size rolls of paper.

The use of strips of paper having adhesive tape along one edge has been known in the prior art for many years, particularly in the refininshing of painted objects, as for example, automotive vehicles and airplanes, where it is necessary to cover portions that are not to be painted with paper held in place by masking tape which is generally centered on one side edge of the paper. The paper that is used usually comes in rolls of a number of different widths. The adhesive stripped paper has been particularly desirable in that it is capable of a quick and easy application, and also, of a quick and easy removal without leaving any mark, or substance, on the protected surface of the vehicle.

The prior art as it has developed, has applied masking tape to the side edge of the paper, either by hand or by sticking the tape on to one side edge of the paper as it is withdrawn from the roll. The roll of paper and roll of tape have been supported in box-like structures which must be supported on a bench, usually at some distance from the work site. A problem exists in holding the paper roll in a fixed position laterally of its support and considerable difficulty occurs in changing rolls of the paper used and in holding the paper in desired alignment with the roll of masking tape. The entire structure is heavy and awkward and must be supported on a rugged bench, which in most instances is remotely located from the work area.

An object of the present invention, therefore, is the provision of a new and improved support for rolls of sheet material which will accommodate rolls of different widths without complicated structure for holding the rolls in accurate alignment with rolls of masking tape.

Another object of the present invention is the provision of a new and improved structure of the above described type which reduces the time spent in obtaining and applying paper having masking tape on one side edge of the work to be masked.

DESCRIPTION OF THE PREFERRED EMBODIMENT

The following specification taken in conjunction with the drawings sets forth examples of the present invention in such a manner that any person skilled in the art, can make and use the invention. The embodiment of the invention disclosed herein, is the best mode contemplated by the inventor in carrying out his invention in a commercial environment, although, it should be understood that various modifications can be accomplished within the parameters of the invention.

Figure 1:
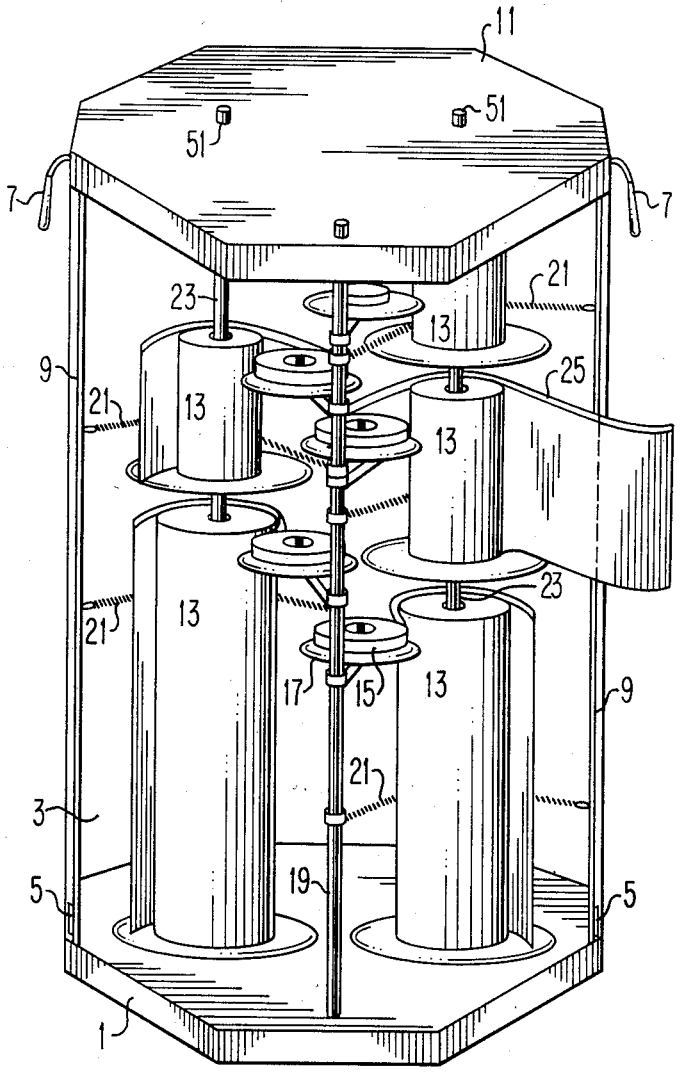
FIG. 1 is a front elevational view of a platform and housing for supporting masking paper and masking tape, and which supplies the tape generally centered over one side edge of the paper.

Referring to FIG. 1, the embodiment of the present invention is disclosed as a perspective view in an operative mode. As can be readily seen from FIG. 1, an operator can utilize the paper dispensing apparatus to easily provide any desired length of paper from any one of several different widths of paper with adhesive tape automatically being applied to one edge of the paper. The component parts of the present invention can be readily seen from FIGS. 1 through 6.

Referring to FIG. 1, a platform member 1, includes a set of tubular members 23, which are anchored in platform member 1, and extend upward therefrom being further secured by top member 11. Tubular shafts 23, are adapted to support rolls of paper of various lengths 13.

The respective shafts are generally aligned in parallel and are biased so as to maintain the revolutions of paper in compact position by means of spring members 21. Tube members 23, are bifurcated and contain an upper detachable portion 51, which is force fitted into the main member 23. As can be best seen in FIG. 5, by raising upper member 51, the main lower member 23, may be angled to the side for purposes of facilitating the replacement of paper rolls onto tublar member 23.

Figure 2:
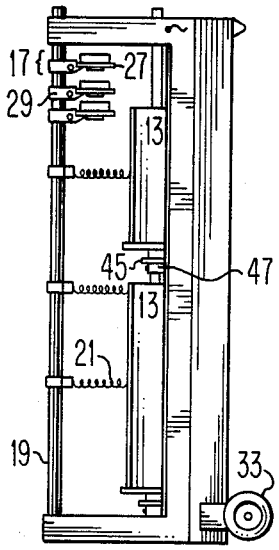
FIG. 2 is a side view of the apparatus shown in FIG. 1.
Figure 3:
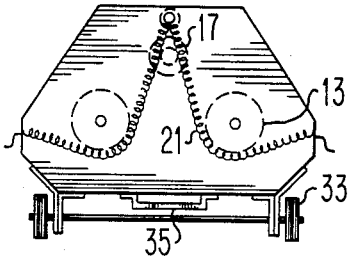
FIG. 3 is a top view of the apparatus shown in FIG. 1.

As can be seen in FIG. 2, the varying lengths of paper rolls 13, are adjusted and supported in position along tubular shaft 23, by means of the washer 45, and adjustable collar combination 47.

As can be seen in FIG. 1, tubular shaft 19, is mounted in and extends from platform member 1, and is further mounted in top member 11, substantially aligned in parallel with tubular paper supporting members 23.

As can be seen in FIG. 2, tubular member 19, is designed to support a plurality of tape dispenser assemblies 17, comprised of a platform member 27, and an adjustable bracket member 29, for supporting a plurality of adhesive tape rolls 15. Housing member 3, is attached to and extends upward from the platform member 1, and is further attached to top member 11, and generally encloses the operating components of the tape and paper dispensing apparatus.

Figure 5:
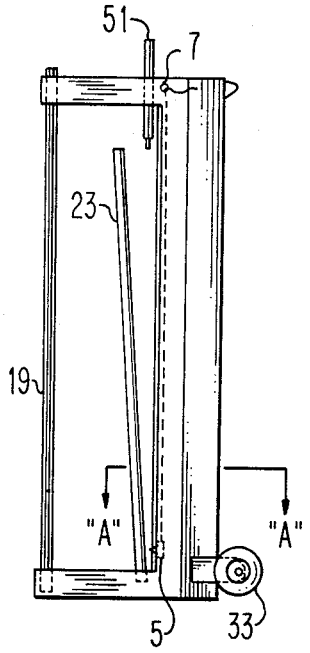
FIG. 5 is a fragmentary sectional view of the embodiment depicting the cutting apparatus.
Figure 6:
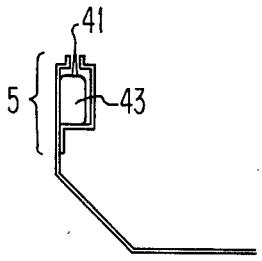
FIG. 6 is a fragmentary sectional view taken approximately along the line A—A showing the cutter detail.

As can be seen from FIG. 6, a paper cutting assembly is provided which includes an angular blade 41, attached to a lead weight 43, whose movement is controlled by pull cord 7, causing said weighted blade assembly to ride in cutter channel 9, located on the terminal surfaces of housing assembly 3, as shown in FIGS. 1 and 5.

Figure 4:
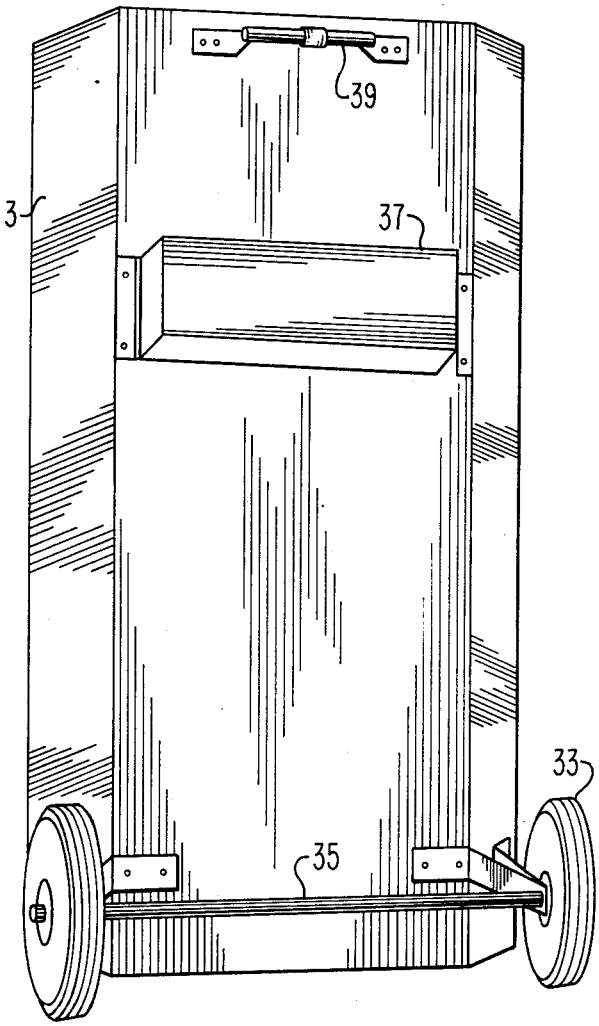
FIG. 4 is a rear elevational view of the platform and housing apparatus shown in FIG. 1.

As can be seen in FIG. 4, a handle member 39, is mounted at the top of the housing assembly 3, and can be readily grasped by the operator to tilt the paper dispensing apparatus and to cause the front base of platform 1, to be lifted so that the paper dispensing apparatus can be appropriately moved by means of wheels 33, connected by shaft 35, to any desired location by the operator. Additionally, storage bin 37, is appropriately mounted to the rear of housing member 3, for the purpose of storing rolls of tape.

In operation, the operator can move the embodiment of the paper dispensing apparatus adjacent the work site and remove the desired length of adhesive taped paper to be used as an apron in any painting job. With the embodiment as shown in FIGS. 1 through 6, the operator has an advantageous selection of the right width of paper for each appropriate application. This ensures an economy of paper and a fast and efficient way of having paper available. Paper rolls and tape rolls can be easily loaded and the paper edge and tape will be aligned at all times.

The embodiment shown provides a positive pressure application of tape to the edge of the paper. Due to spring biasing means, the tape will follow the paper roll as it shrinks in diameter during use and the springs also act as a brake. Thus, the tape can be positively applied without requiring extra guides and rollers to provide the desired pressure application.

By means of the angled and weighted blade assembly, a desired length of adhesive taped paper may be provided by merely pulling cord 7, thus causing blade assembly 5, to travel in a vertical direction thus cutting the desired length of paper. Upon release of cord 7, weight 43, returns the cutting assembly 5, to its starting position located at the base of the cutter channel 9.

While the preferred embodiment of the present invention has been described hereinabove, it is intended that all matter contained in the above description and shown in the accompanying drawings be interpreted as illustrative and not in a limiting sense and that all modifications, constructions and arrangements which fall within in the scope and spirit of the invention may be made.

What is claimed is:

1. A paper and tape dispensing apparatus for rolls of paper comprising:

A platform member;

A housing member attached to and extending upward from said platform member;

A top member;

Two telescopically detachable shafts of equal length attached to the platform and top members to support respective different widths of paper rolls;

A shaft attached to the platform and top members to support a plurality of adhesive tape rolls;

Cutting means for providing specified lengths of paper with an adhesive tape applied to an edge of said paper;

Spring members for securing said paper rolls;

A washer and adjustable collar assembly for positioning said paper rolls along said shafts;

An adjustable platform assembly for positioning said adhesive tape rolls along said shafts;

Wheels attached to the rear of said platform member;

Handle means attached to the housing member for rotating the platform member about the wheels to transport the paper dispensing apparatus supported only by the wheel means; and A storage bin mounted on the rear of said housing member.

2. The invention of claim 1 wherein said cutting means comprises an angled utility blade whose movement is controlled by a weighted pull cord.

* * * * *